US012543867B2

(12) United States Patent
Miskizak et al.

(10) Patent No.: US 12,543,867 B2
(45) Date of Patent: Feb. 10, 2026

(54) VERTICAL OR SEMI-VERTICAL REFRIGERATED DISPLAY CABINET WITH A BLOWING SHELF

(71) Applicant: EPTA S.p.A., Milan (IT)

(72) Inventors: Alexandre Miskizak, Milan (IT); Julien Granouillac, Milan (IT); Lionel Vasseur, Milan (IT); Patrick Cazalis, Milan (IT); Laurent Narbaitz, Milan (IT)

(73) Assignee: EPTA S.P.A., Milan (IT)

( * ) Notice: Subject to any disclaimer, the term of this patent is extended or adjusted under 35 U.S.C. 154(b) by 146 days.

(21) Appl. No.: 18/307,488

(22) Filed: Apr. 26, 2023

(65) Prior Publication Data

US 2023/0346139 A1 Nov. 2, 2023

(30) Foreign Application Priority Data

Apr. 27, 2022 (IT) ..... 102022000008312

(51) Int. Cl.
*A47F 3/04* (2006.01)

(52) U.S. Cl.
CPC ..... *A47F 3/0447* (2013.01); *A47F 2003/046* (2013.01)

(58) Field of Classification Search
CPC ..... A47F 3/0447; A47F 2003/046; A47F 3/0443; A47F 3/04; A47F 3/0482;
(Continued)

(56) References Cited

U.S. PATENT DOCUMENTS

2008/0284296 A1* 11/2008 Steele et al. ..... A47F 3/0447 312/236
2016/0113418 A1* 4/2016 Wood et al. ..... A47F 3/0447 108/50.18

FOREIGN PATENT DOCUMENTS

DE 202014001867 U1 * 3/2014 ..... A47F 11/10
EP 1414327 B1 6/2008
(Continued)

OTHER PUBLICATIONS

JP 2014108180 A Translation (Year: 2014).*
(Continued)

*Primary Examiner* — Jerry-Daryl Fletcher
*Assistant Examiner* — Dario Antonio Deleon
(74) *Attorney, Agent, or Firm* — Armstrong Teasdale LLP

(57) ABSTRACT

A refrigerated display cabinet of vertical or semi-vertical type has a containment structure defining a display compartment and an access opening, a main air inlet mouth and a main air outlet mouth being in communication with the display compartment. A channel connects the main air inlet and outlet mouths to direct a refrigerated air flow towards the main air inlet mouth in the form of an air curtain. The display compartment is divided into an upper area having one or more shelves and a lower area adapted to be loaded with products. One shelf separating the lower and upper areas is a blowing shelf having an internal conduit directing the refrigerated air flow in the display compartment through a secondary air-emitting mouth, a first deflector intercepting the refrigerated air flow which forms the air curtain and a second deflector intercepting the refrigerated air flow emitted by the blowing shelf.

28 Claims, 10 Drawing Sheets

(58) Field of Classification Search
CPC .... A47F 3/0408; A47F 7/0071; A47F 3/0439; A47F 5/12; F25D 23/023
USPC ..... 62/256
See application file for complete search history.

(56) References Cited

FOREIGN PATENT DOCUMENTS

| | | | | | |
|---|---|---|---|---|---|
| FR | 2764787 | A1 | * | 12/1998 | ..... A47F 3/0447 |
| JP | H10300315 | A | | 11/1998 | |
| JP | 2011131036 | A | * | 7/2011 | ..... A47F 3/04 |
| JP | 2014108180 | A | * | 6/2014 | ..... A47F 3/04 |
| WO | 2011121284 | A2 | | 10/2011 | |

OTHER PUBLICATIONS

DE 202014001867 U1 Translation (Year: 2014).*
JP 2011131036 A Translation (Year: 2011).*
FR 2764787 A1 Translation (Year: 1998).*
Italian Search Report for Patent Application No. IT 202200008312, mailed Dec. 9, 2022, The Hague, NL.

* cited by examiner

VERTICAL OR SEMI-VERTICAL REFRIGERATED DISPLAY CABINET WITH A BLOWING SHELF

CROSS-REFERENCE TO RELATED APPLICATION

This application claims priority to Italian Patent Application No. 102022000008312 filed Apr. 27, 2022, the entire contents of which is hereby incorporated in its entirety by reference.

FIELD OF THE INVENTION

The present invention relates to a vertical or semi-vertical refrigerated display cabinet with a blowing shelf.

The refrigerated display cabinet according to the present invention finds particular application in the commercial refrigeration field.

BACKGROUND ART

When selling fresh foodstuffs, it is necessary that the latter are kept refrigerated at a positive temperature, for example between −1° C. and +5° C. for a correct storage which avoids the qualitative and hygienic deterioration thereof.

In public sales areas, vertical or semi-vertical refrigerated display cabinets or counters are used, which are adapted to visually display the goods so that they can be purchased.

Vertical or semi-vertical display cabinet means a cabinet having a display compartment extending at least partially vertically. The vertical display compartment is accessible from the front through an access opening. The semi-vertical cabinet, as defined in standard ISO 23953-1, has an opening which allows the visibility of the products the maximum height of which is less than 1.5 m.

In order not to obstruct the visibility of the fresh product, both packaged and unpackaged, refrigerated display cabinets with a display compartment closed by transparent doors or with a display compartment open towards the outside environment and without doors are used.

Refrigerated display cabinets operating with thermodynamic vapor-compression cycles generally contain at least one evaporating section in which the evaporation of a coolant fluid removes heat from the air inside the refrigerated display cabinet circulated in a forced manner by ventilation means or by natural circulation.

The basic mechanism through which food loses heat is substantially dependent on the heat exchange mechanisms between the foodstuffs and the surrounding environment. Typically, in open display cabinets, food acquires heat by radiation from the warm outside parts and is cooled by cold air from the evaporator of the cabinet and suitably conveyed towards the most heated foodstuffs.

In refrigerated display cabinets, and in particular the vertical ones with shelves, the use of air curtains to insulate the goods from the surrounding warm environment is known. The air curtain has the dual purpose of separating the air inside the cabinet from the air outside, so as to reduce the convective heat exchange and, as shown, to bring cold air near the foodstuffs for removing the heat radiated thereon. The air curtain is the only means which prevents the infiltration of hot air in open cabinets, but it also makes a useful contribution in closed versions.

The effectiveness of the air curtains is strongly linked to the interaction between the air flows inside the cabinet and those outside, for example generated by natural convection or from the environmental cooling and conditioning system. The main parameters are: thickness and speed of the air curtain; length of the air curtain, i.e., the space that the air travels from an outlet grille to an intake grille; inclination of the air curtain. Furthermore, an air curtain is significantly affected by the variations in air density and temperature, parameters which, in turn, are a function of heat transport mechanisms.

As shown in FIG. 1, the air curtains C enclose the product between the front part of the cabinet (open or closed by transparent doors) and the rear part of the cabinet, which houses the technical section with the evaporator and fans which generate the air flow rate necessary to feed the air curtain. The air thus recirculates in a sort of ring which, in the most typical version, places the delivery grille A, the intake grille B, the fans V and the evaporator E in an aerodynamic series.

In the art, many possibilities are known for arranging air curtains to improve a basic performance. For example, several air curtains can be arranged, nested one inside the other, or the refrigerated space can be divided into a number of air curtains in sequence, but shorter in length, as described, for example, in WO2011121284A2.

Air curtains are often supported by a part of air flow rate which comes from the rear part of the refrigerated compartment, or "back panel", and crosses the display compartment, with the function of contributing to the vertical stability of the curtain. A known example of an arrangement of the air curtains in an open vertical cabinet is described in EP1414327B1, as shown in FIGS. 2 and 3. In particular, FIG. 2 shows a second air curtain which is not completely recirculated and generated with a fan which draws outside air from the roof of the cabinet, which is conducted to a grille coplanar with the delivery grille, so as to guide the second curtain parallel to the first, more internal one.

The encounter between the vertical flow of the air curtain and the horizontal flow from the inside of the cabinet can, however, generate turbulence which can cause mixing and incorporation of air from the outside environment and thus weaken the air curtain.

This phenomenon is particularly accentuated if the horizontal flow from the inside of the cabinet is also generated by a blowing shelf (i.e., a shelf which internally defines an air passage conduit, fluidically connected to the refrigerated air circulation circuit). In fact, with respect to when the horizontal air flow comes from openings obtained in the rear wall of the display compartment, the flow exiting the blowing shelf is directly introduced near the vertical flow of the air curtain.

Usually, the air curtain circulates from the top to the bottom, aided by the greater density of the circulating air, this being at a lower temperature than room temperature. As it descends towards the intake grille, the air curtain heats up due to the heat exchange with the foodstuffs, and especially due to mixing with the air outside the cabinet, which is caused by the turbulence of the fluid.

For such a reason, in some types of vertical refrigerated cabinets, the foodstuffs located in the lower part I of the cabinet are therefore those at the higher temperature. In a refrigerated cabinet, the performance in terms of temperature is defined by the maximum (and minimum) temperature reached by the foodstuffs during the operation under conditions defined, for example, by the standard ISO 23953-2. The upper part S of the cabinet, on the other hand, is at a temperature which is unnecessarily lower, it does not contribute to improving the performance in temperature at the positive extreme thereof and risks worsening it by extending it to the negative extreme thereof, and it also has the drawback of increasing the heat which penetrates the cabinet by radiation, thus increasing the overall energy consumption thereof.

This issue is particularly apparent in refrigerated display cabinets of a vertical or semi-vertical type which include some loading arrangements of the goods with a stepped portion in the lower area of the display compartment, which are typical in hard discounts (as shown in FIGS. 4*a* and 4*b*, corresponding to FIGS. 22 and 26 of ISO23953-2). Typically, in these refrigerated display cabinets, the lower area of the display compartment protrudes frontally with respect to the shelves which divide the upper part of the display compartment into units, and in particular the lower area I can be defined by a tub.

The portion of product placed overhanging from the upper shelves (stepped portion, highlighted with a circle in FIG. 5) receives heat radiated from the environment outside the refrigerated compartment both from the frontal direction and vertically from above.

In order to obviate this problem, in some embodiments of the prior art, the flow rate of refrigerated air sent to the lower part of the cabinet is increased with a dual purpose:

- increasing the speed of the air which strikes the foodstuffs thus increasing the local convective heat exchange coefficient; and
- at the same time, injecting air at a lower temperature than that from the delivery grille to reduce the average temperature thereof and therefore remove more heat from the foodstuffs.

Increasing the speed of the air and the thermal gradient in the lower part of the cabinet allows decreasing such parameters in the upper part by the amount not required to reach the performance class limit temperature. The overall result obtained is to better balance the performance achieved and thus reduce energy consumption.

As already mentioned, the introduction of a flow of refrigerated air into the lower section of a display cabinet can occur either directly in the display compartment by means of openings made on the rear panel, or indirectly by means of a blowing shelf. An example of cabinet which incorporates both of such solutions is shown in FIG. 1.

The air flow from the opening on the rear panel of the cabinet or from the blowing shelf tends to maintain a horizontal flow direction, also by virtue of the conveying effect caused by the presence of the products. Such a horizontal air flow then joins the air curtain which flows vertically in front of the opening to access the display compartment. The horizontal air flow is forced to change direction to align with the vertical air curtain.

As already highlighted, the joining of such flows (one substantially vertical, and one substantially horizontal) may however generate turbulence and air recirculation which can cause the incorporation of hotter outside air through the air curtain.

As shown in FIG. 6, the generation of turbulence and air recirculation is particularly accentuated in display cabinets with stepped loading of the goods. In fact, the air curtain C, descending from above near the shelves R, impacts against the products P which, in the stepped loading, protrude with respect to the shelves R themselves, and undergoes a particularly abrupt change of direction. This can generate marked air recirculations and turbulences T which decrease the effectiveness of the insulation of the air curtain (incorporation of outside air) and phenomena of laminar flow detachment which locally reduce the coefficient of the heat exchange with the foodstuffs right in the most irradiated point highlighted with a circle in FIG. 5.

The effect linked to a possible increase in the speed of the horizontal air flow O (aimed at increasing the local convective heat exchange coefficient) would be substantially cancelled by the increase in turbulence generated by the collision between the horizontal flow and the air curtain.

Therefore, the aforesaid fluid dynamic phenomena reduce the cooling efficiency in refrigerated display cabinets of a vertical or semi-vertical type at the stepped loading portion.

Therefore, in the field of commercial refrigeration, there is a need to increase the cooling efficiency in refrigerated display cabinets of a vertical or semi-vertical type by reducing the turbulence deriving from the joining of the refrigerated air flows of the air curtain and the blowing shelf, respectively, at the stepped loading portion.

SUMMARY OF THE INVENTION

Therefore, it is the object of the present invention to eliminate or at least mitigate the drawbacks of the prior art cited above, by providing a refrigerated display cabinet of a vertical or semi-vertical type with a blowing shelf which allows reducing the turbulence deriving from the joining of the refrigerated air flows of the air curtain and the blowing shelf, respectively, at the stepped loading portion.

It is a further object of the present invention to provide a refrigerated display cabinet of a vertical or semi-vertical type with a blowing shelf which allows increasing the cooling efficiency at the portion for the stepped loading of the products inside the display compartment.

It is a further object of the present invention to provide a refrigerated display cabinet of a vertical or semi-vertical type with a blowing shelf, which is constructionally simple to manufacture, with plant costs comparable to similar conventional refrigerated cabinets.

It is a further object of the present invention to provide a refrigerated display cabinet of a vertical or semi-vertical type with a blowing shelf, which is reliable and operatively simple to manage.

BRIEF DESCRIPTION OF THE DRAWINGS

The technical features of the invention according to the aforesaid objects can be clearly found in the contents of the claims hereinbelow and the advantages thereof will become more apparent from the following detailed description, given with reference to the accompanying drawings which show one or more embodiments thereof merely given by way of non-limiting example, in which:

Elements or parts in common to the embodiments described will be indicated hereafter using the same reference numerals.

DETAILED DESCRIPTION

Figure 1:
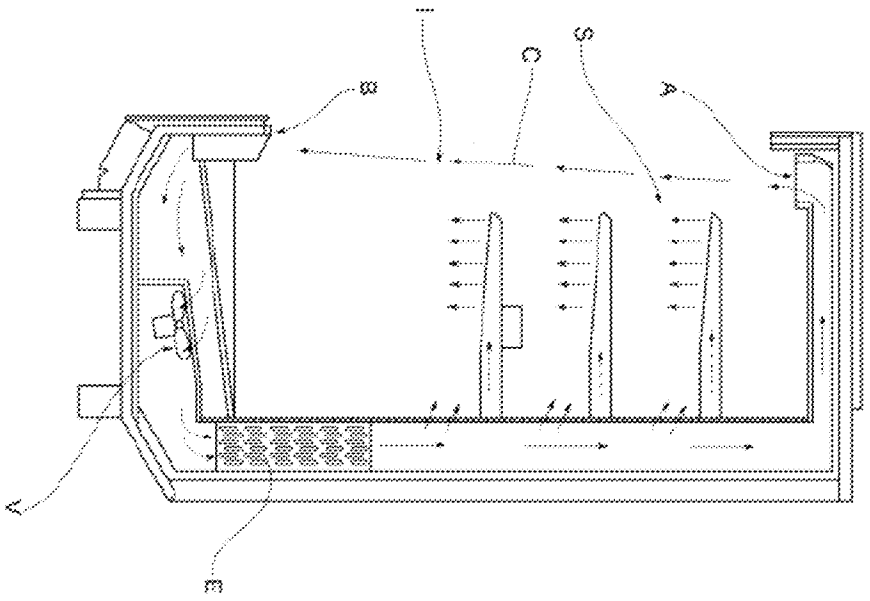
FIG.1 (PRIOR ART)
FIG. 1 shows an orthogonal, vertical section view of a vertical refrigerated display cabinet of the conventional type.
Figure 2:
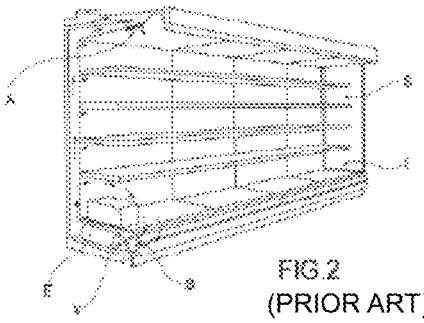
FIG.2 (PRIOR ART)
FIGS. 2 and 3 show a perspective view and an orthogonal, vertical section view, respectively, of another example of a vertical refrigerated display cabinet of the conventional type with double curtain.
Figure 3:
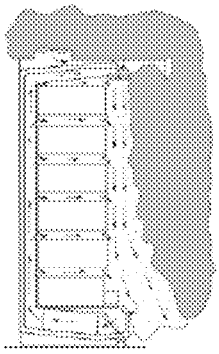
FIG.3 (PRIOR ART)
Figure 4B:
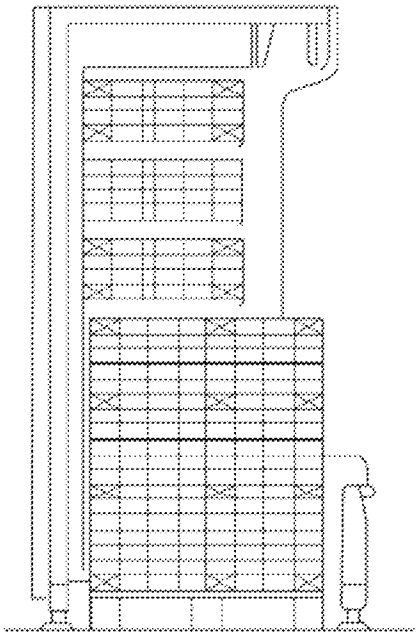
FIG.4b (PRIOR ART)
FIGS. 4*a* and 4*b* show a vertical section of two different refrigerated display cabinets having a stepped portion of some loadings typical of the hard discount, corresponding to FIG. 22 and FIG. 26 of ISO23953-2, respectively.
Figure 4A:
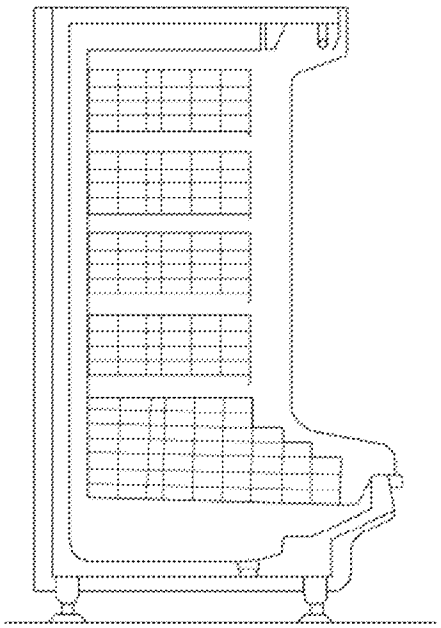
FIG.4a (PRIOR ART)
Figure 5:
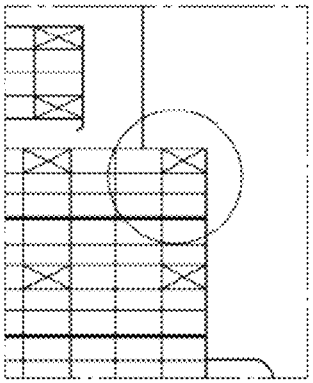
FIG.5 (PRIOR ART)
FIG. 5 shows an enlarged view of a detail in FIG. 4*b;*
Figure 6:
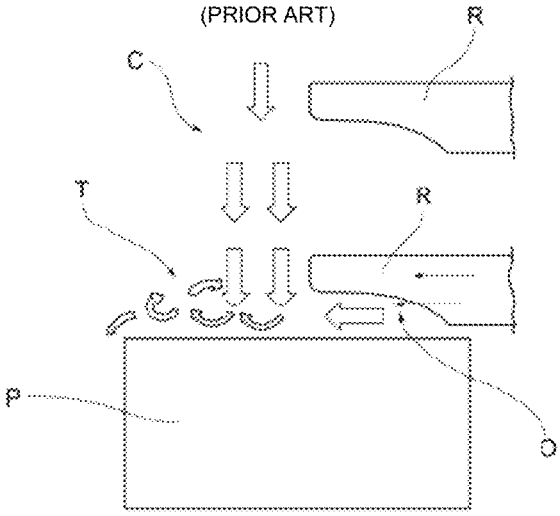
FIG.6 (PRIOR ART)
FIG. 6 shows a diagrammatic depiction of the turbulence which can be generated by the encounter between the air curtain and the horizontal flow generated by a blowing shelf in a conventional refrigerated cabinet at a stepped loading area.

The present invention relates to a refrigerated display cabinet of a vertical or semi-vertical type with a blowing shelf.

With reference to the accompanying Figures, reference numeral 1 indicates as a whole a refrigerated display cabinet of a vertical or semi-vertical type with a blowing shelf according to the present invention.

Here and in the following description and claims, reference will be made to the cabinet 1 in a use condition. Any references to a lower or upper position or to a horizontal or vertical orientation must therefore be understood in this sense.

In accordance with a general embodiment of the present invention, the refrigerated display cabinet 1 comprises a containment structure 2 which defines a product display compartment 3 and an access opening 4 to such a compartment 3.

In particular, the containment structure 2 consists of a box-shaped body comprising a base for being supported on the ground (which, in particular, can consist of a tub), a rear wall, a top cover, as well as, preferably, two end side walls, or the predisposition for the connection to a subsequent section of an identical cabinet.

On the cabinet 1 it is possible to identify:

- a main axis X, along which the cabinet extends in length, in particular between the two end side walls; and
- a secondary axis Y along which the cabinet develops in depth, horizontally and transversally to the main axis X.

The access opening 4 can be lacking doors or it can be provided with transparent doors so as to completely close the product display compartment 3 from the outside.

Figure 7:
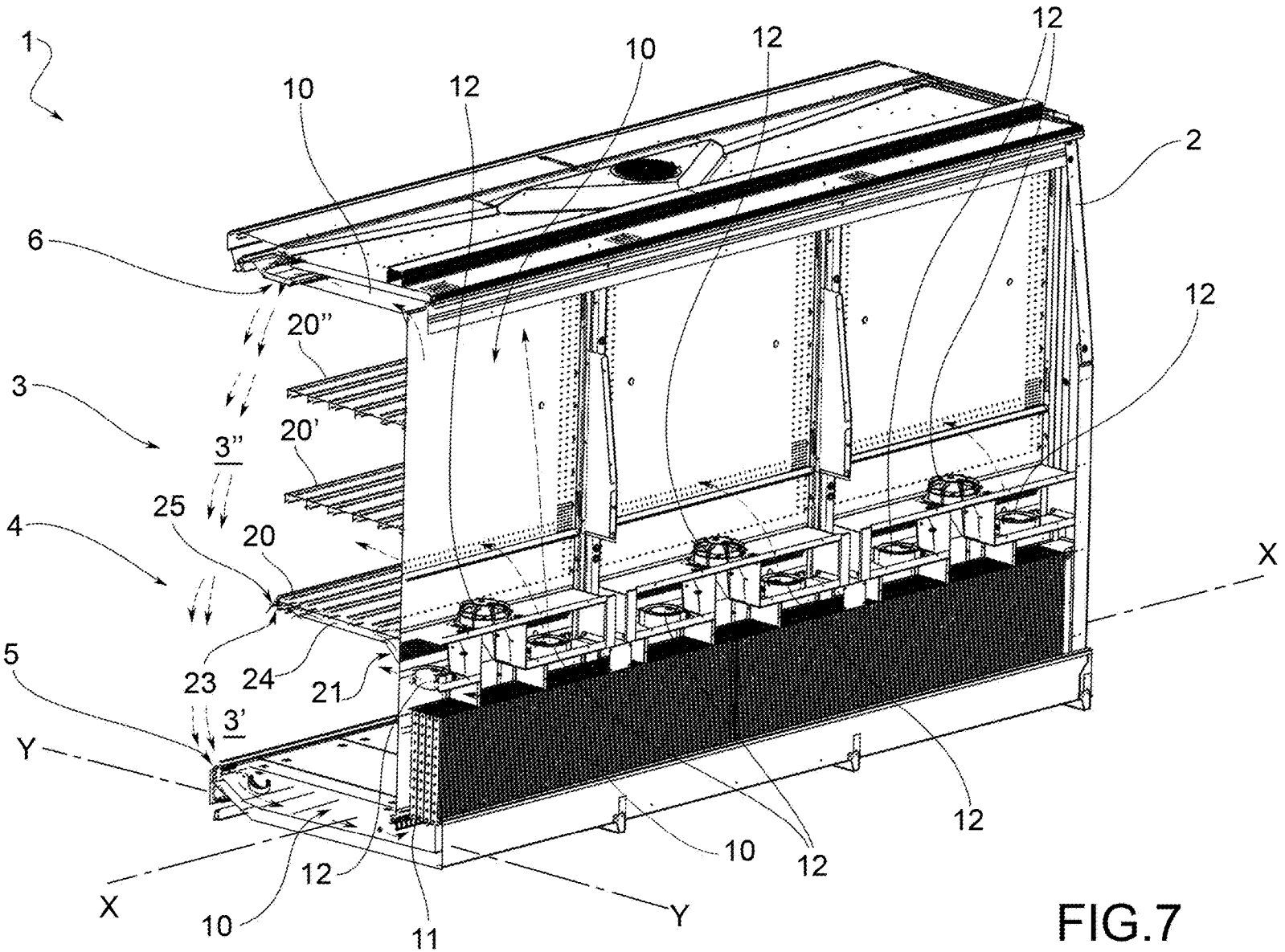
FIG. 7 shows a vertical section perspective view (with some parts removed to better highlight others) of a refrigerated display cabinet in accordance with an embodiment of the present invention.
Figure 8:
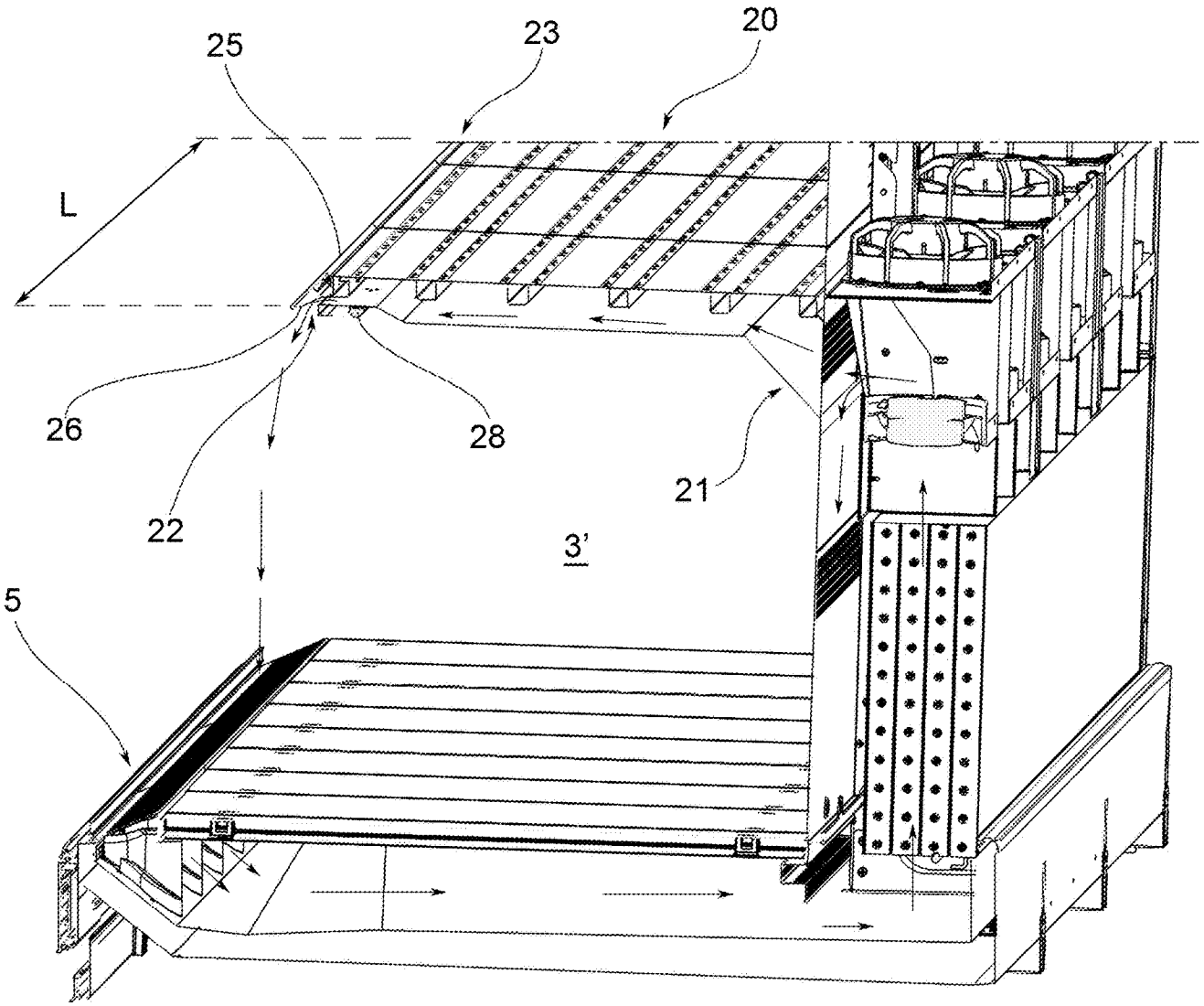
FIG. 8 shows a perspective view of a portion of the refrigerated cabinet shown in FIG. 7.

As shown in particular in FIG. 7, the containment structure 2 further comprises a main air inlet mouth 5 and a main air outlet mouth 6 both in communication with the product display compartment 3.

The refrigerated display cabinet 1 further comprises a channel 10 which fluidically connects the main air inlet mouth 5 to the main air outlet mouth 6 so as to direct a refrigerated air flow through the main air outlet mouth 6 towards the main air inlet mouth 5 along at least one portion of the access opening 4 in the form of an air curtain.

The channel 10 contains at least one evaporator 11 connected to a refrigeration circuit (such a circuit is not shown in the attached Figures) and a plurality of fans 12. In use, the activation of the fans 12 generates, in particular, a circulation of air inside the cabinet 1 or the channel; such an air flow, passing through the evaporator, cools down; a flow of refrigerated air is thus generated which is used to generate the cold air curtain and to cool the products contained in the display compartment 3.

Advantageously, the channel 10 can directly communicate with the display compartment 3 so as to directly introduce a flow of refrigerated air into several areas of the product display compartment 3. In particular, such a direct communication can be achieved by means of openings made on the rear wall of the product display compartment 3.

The product display compartment 3 is divided into:

- an upper area 3" comprising one or more shelves 20, 20' and 20" vertically overlapping each other; and
- a lower area 3' which has a greater extension in depth than the upper area 3" and is intended to be loaded with products with a stepped arrangement protruding in depth with respect to the one or more shelves 20, 20' and 20".

At least one shelf 20 of said shelves which separates the lower area 3' from the upper area 3" consists of a blowing shelf.

The blowing shelf 20 which separates the lower area 3' from the upper area 3" comprises an internal conduit 24 fluidically connected to the channel 10 at a fixing end 21 of the blowing shelf 20 to the containment structure 2. The blowing shelf 20 is suitable to direct a refrigerated air flow in the product display compartment 3 through a secondary air-emitting mouth 22 obtained near a free end 23 of the blowing shelf 20, opposite to the fixing end 21.

The main air outlet mouth 6 and the refrigerated display cabinet 1 are globally configured so that the flow of refrigerated air forming the air curtain laps the free end 23 of the blowing shelf 20.

In accordance with a first aspect of the present invention, the blowing shelf 20 comprises a first deflector 25 which is positioned at the free end 23 so as to at least partially intercept the flow of refrigerated air which forms the air curtain and is oriented so as to impart a horizontal component to said flow.

Operatively, the first deflector 25 is configured and positioned with respect to the flow of refrigerated air which forms the air curtain so as to substantially influence the field of motion thereof.

Figure 9:
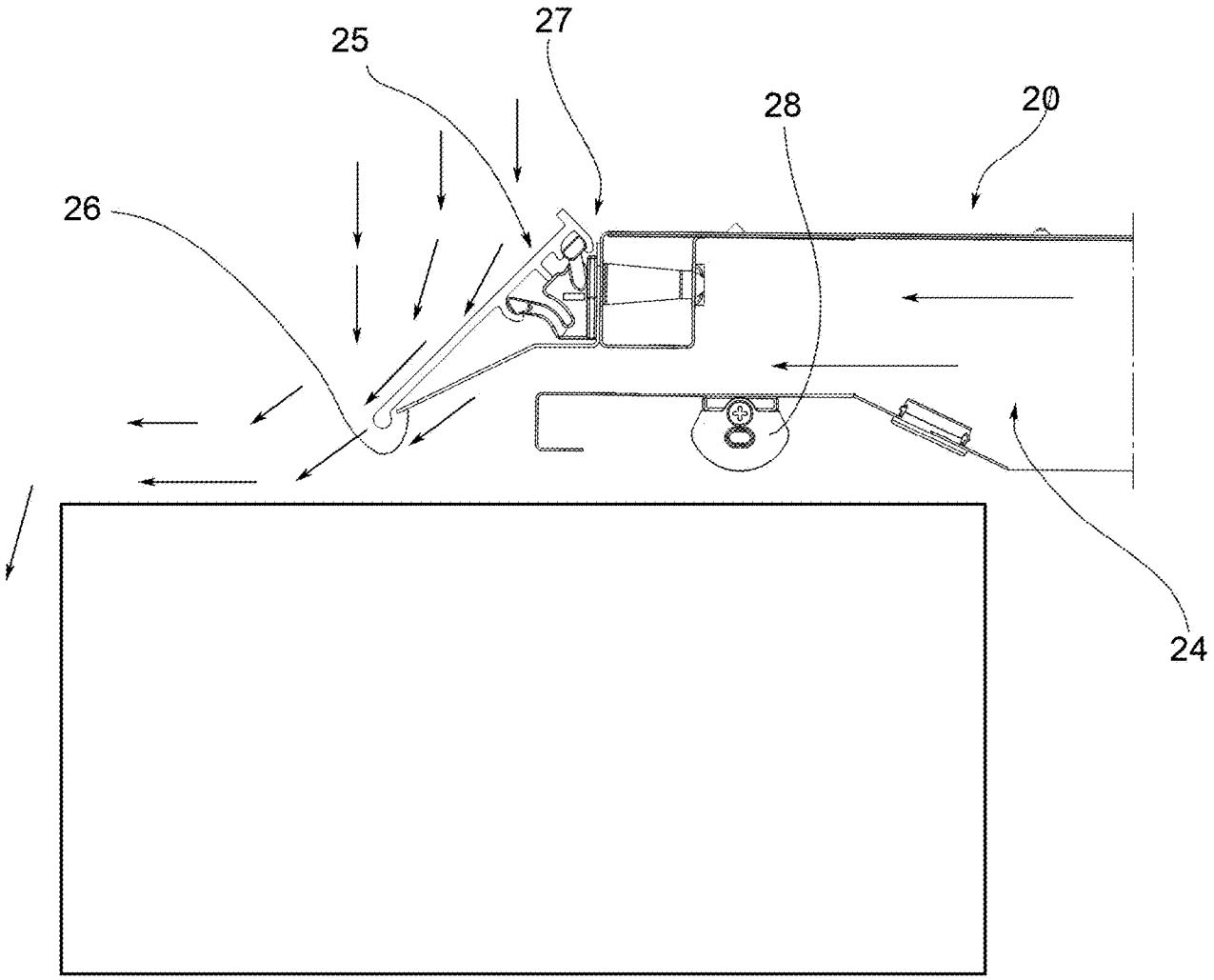
FIG. 9 shows a diagrammatic depiction of the fluid dynamics in the area where the flow of refrigerated air from the air curtain meets the flow of air generated by the blowing shelf in the refrigerated cabinet shown in FIG. 8.

Thereby, as shown in FIG. 9, the air flow which forms the air curtain (from above) meets the surface of the first deflector 25. The air flow, concentrating in the end area of the first deflector 25 changes direction, switching from a substantially vertical flow to a "deviated" flow (with a horizontal component). The first deflector 25 therefore prepares the air flow to the change of direction before meeting the 90° surface of the products arranged in a stepped configuration in the area of the display compartment 3 below the blowing shelf 20. The first deflector therefore prevents the air flow from undergoing the abrupt change of direction (from vertical to horizontal) which would instead be imposed by the products arranged in a stepped configuration in the area of the display compartment 3 below the blowing shelf 20. This significantly reduces turbulence phenomena which would lead to the incorporation of hot outside air.

The presence of the first deflector 25 also has a further effect. The air flow, by virtue of the air motion property of adhering to the surfaces met (Coanda effect), concentrates in the end area of the first deflector 25, thus increasing in speed. The increase in speed of the air flow projected beyond the profile 25 to meet the underlying foodstuffs locally increases the convective heat exchange coefficient, thus improving the cooling of the products arranged in the area of the display compartment which usually has higher average temperature values.

Preferably, as shown in particular in FIG. 9, the first deflector 25 connects to the free end 23 of the blowing shelf 20 so that there is not any through opening between the first deflector 25 and the shelf 20. Thereby, all the air flow which forms the air curtain is subjected, directly or indirectly, to the action of the first deflector 25. In this way, air infiltrations between the first deflector 25 and the blowing shelf 20, which would generate unwanted turbulence, are avoided.

In accordance with a second aspect of the present invention, the blowing shelf 20 comprises a second deflector 26 which is positioned at the outlet of the secondary air-emitting mouth 22 so as to at least partially intercept the refrigerated air flow emitted by the blowing shelf 20.

The second deflector 26 is oriented with respect to the first deflector 25 so that the refrigerated air flow emitted by the blowing shelf 20 and deviated by the second deflector 26 has substantially the same direction as that taken by the refrigerated air flow which forms the air curtain downstream of the first deflector 25.

Operatively, the second deflector 26 is configured and positioned with respect to the flow of air emitted by the blowing shelf 20 to substantially influence the field of motion thereof.

Thereby, by virtue of the second deflector 26, the air flow emitted by the blowing shelf 20 can join, in the same direction, the air flow of the air curtain coming from the upper part and deviated by the first deflector 25. The result is a reduced turbulence in the area where the two flows join and therefore a reduced incorporation of hot outside air.

The flow of refrigerated air (given by the joining of the two flows) then proceeds in an almost horizontal direction until it passes the edge of the foodstuffs and falls back, by virtue of the density gradient, in the lower part, in the direction of the main air inlet mouth 5.

Globally, the first deflector 25 and the second deflector 26 cooperate synergistically to reduce the turbulence phenomena which occur in the area where the flow of the air curtain joins the flow emitted by the blowing shelf at the product loading area with stepped configuration. All of this improves the cooling efficiency of the products arranged in the area of the display compartment which usually has higher average temperature values.

Preferably, the first deflector 25 may be configured to also act as a ticket holder.

Preferably, as shown in particular in FIG. 9, the first deflector 25 substantially connects with the second deflector 26 in the outlet area of the air flows. This favours the joining of the two air flows, further reducing unwanted turbulence phenomena.

In accordance with the embodiment shown in the attached Figures, the first deflector 25 and the second deflector 26 are parts of a single assembled body 27. Thereby, it is possible to more easily install the two deflectors in the cabinet 1, thus ensuring, at the same time, a correct mutual positioning.

Advantageously, the assembled body 27 comprises a fixing wall 27*a* which connects the two deflectors and at which the assembled body can be fixed to the free end 23 of the blowing shelf 20.

In accordance with the embodiments shown in the attached Figures, the first deflector 25 defines a deviation surface 25*a* of the refrigerated air flow, which is oriented towards the outside of the display compartment 3 and is facing upwards.

Figure 10:
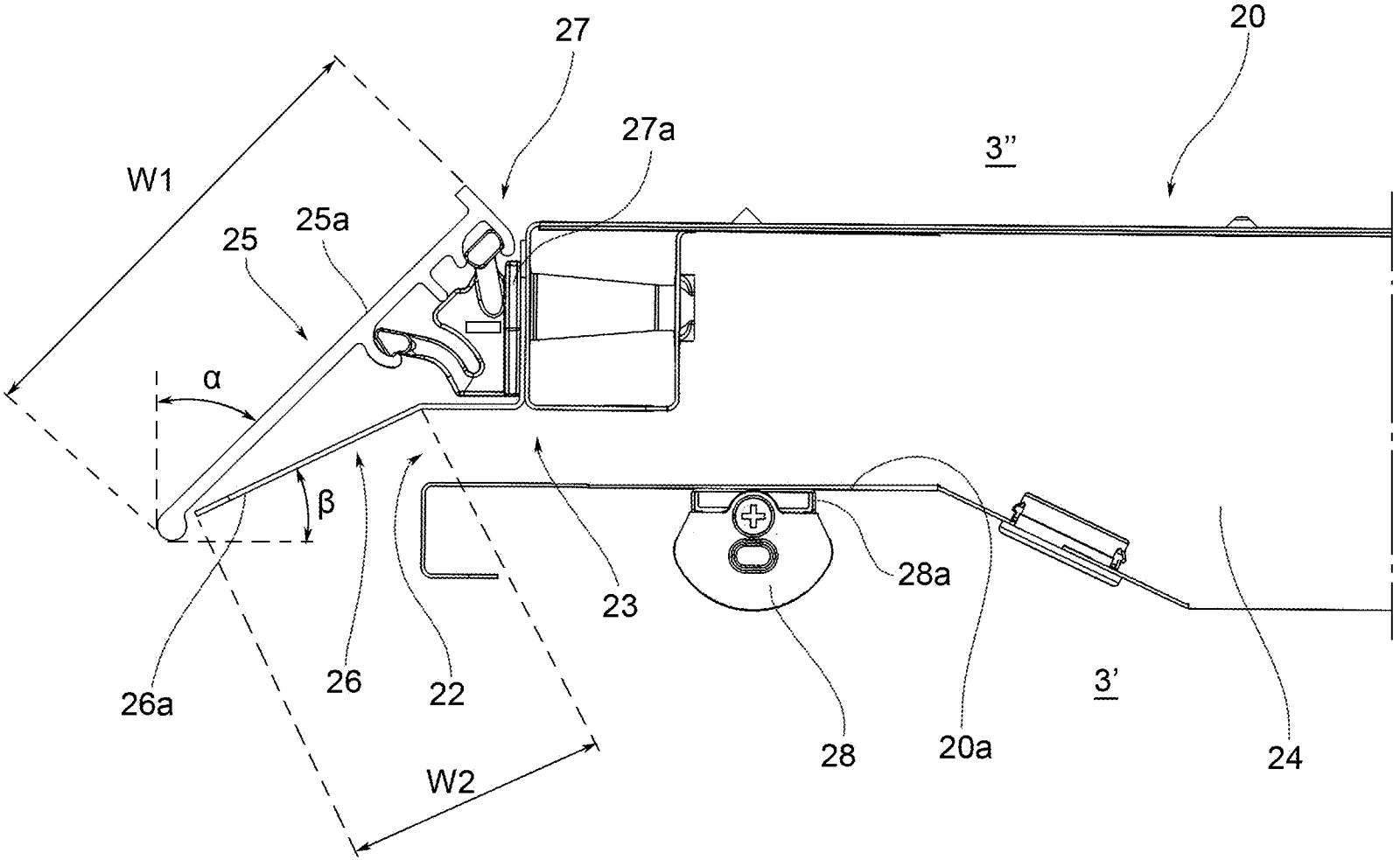
FIG. 10 shows an enlarged view of a detail of the blowing shelf shown in FIG. 9.
Figure 12:
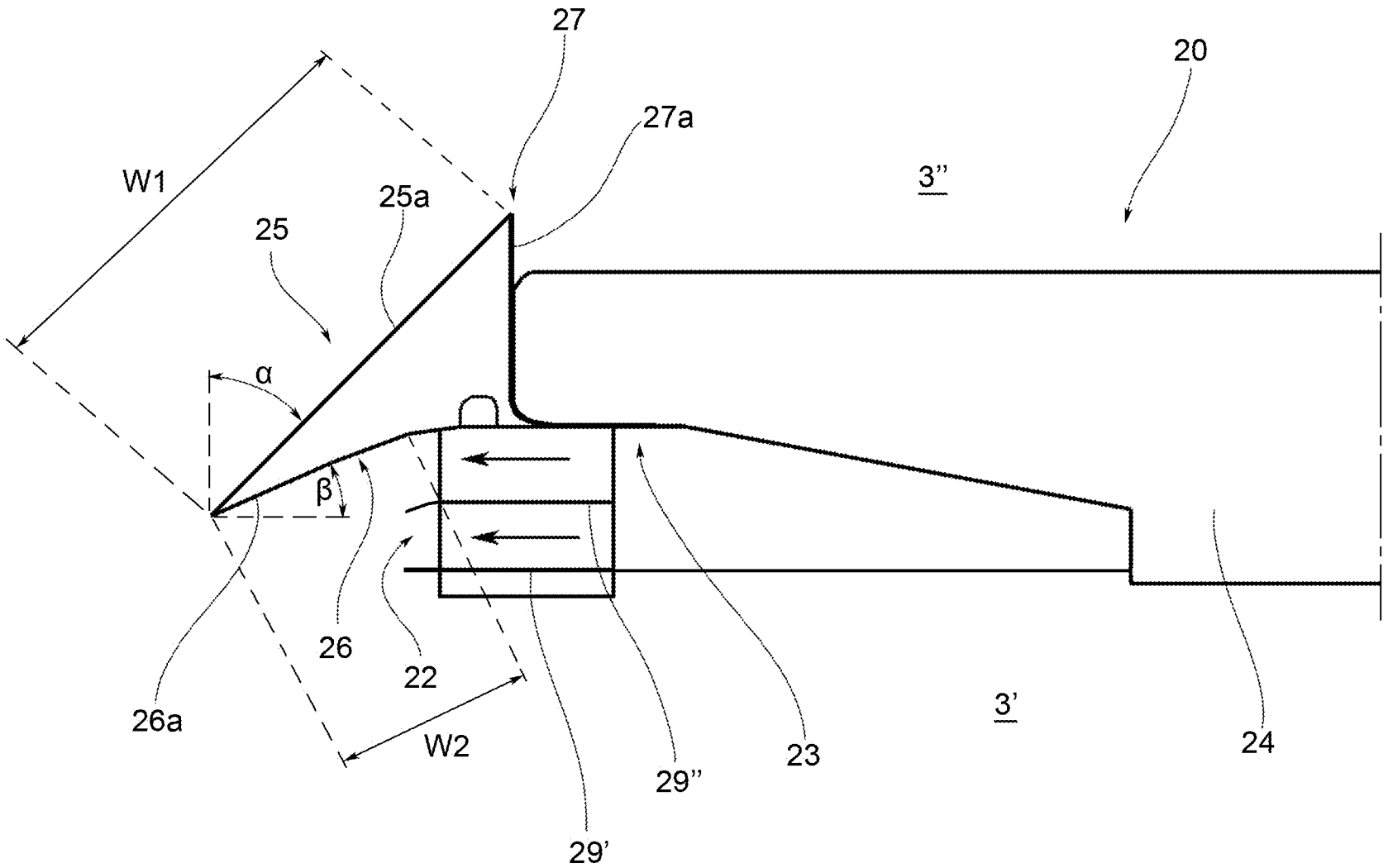
FIG. 12 shows an enlarged view of a blowing shelf according to a further alternative embodiment of the present invention.

In accordance with a preferred embodiment, shown in FIGS. 9, 10 and 12, the deviation surface 25*a* of the first deflector 25 is defined by a flat surface, inclined towards the outside of the display compartment 3 by a first predefined angle $\alpha$ with respect to a vertical plane.

Advantageously, the first predefined angle $\alpha$ is between 40° and 50°, preferably between 42° and 48°, and even more preferably equal to 45°. It has been experimentally verified that, in the case of a flat deflector, such angular values allow obtaining the best compromise between the need to reduce the turbulence induced by the impact of the air flow on the first deflector 25 and the need to impose the higher horizontal component to the flow itself.

Figure 11:
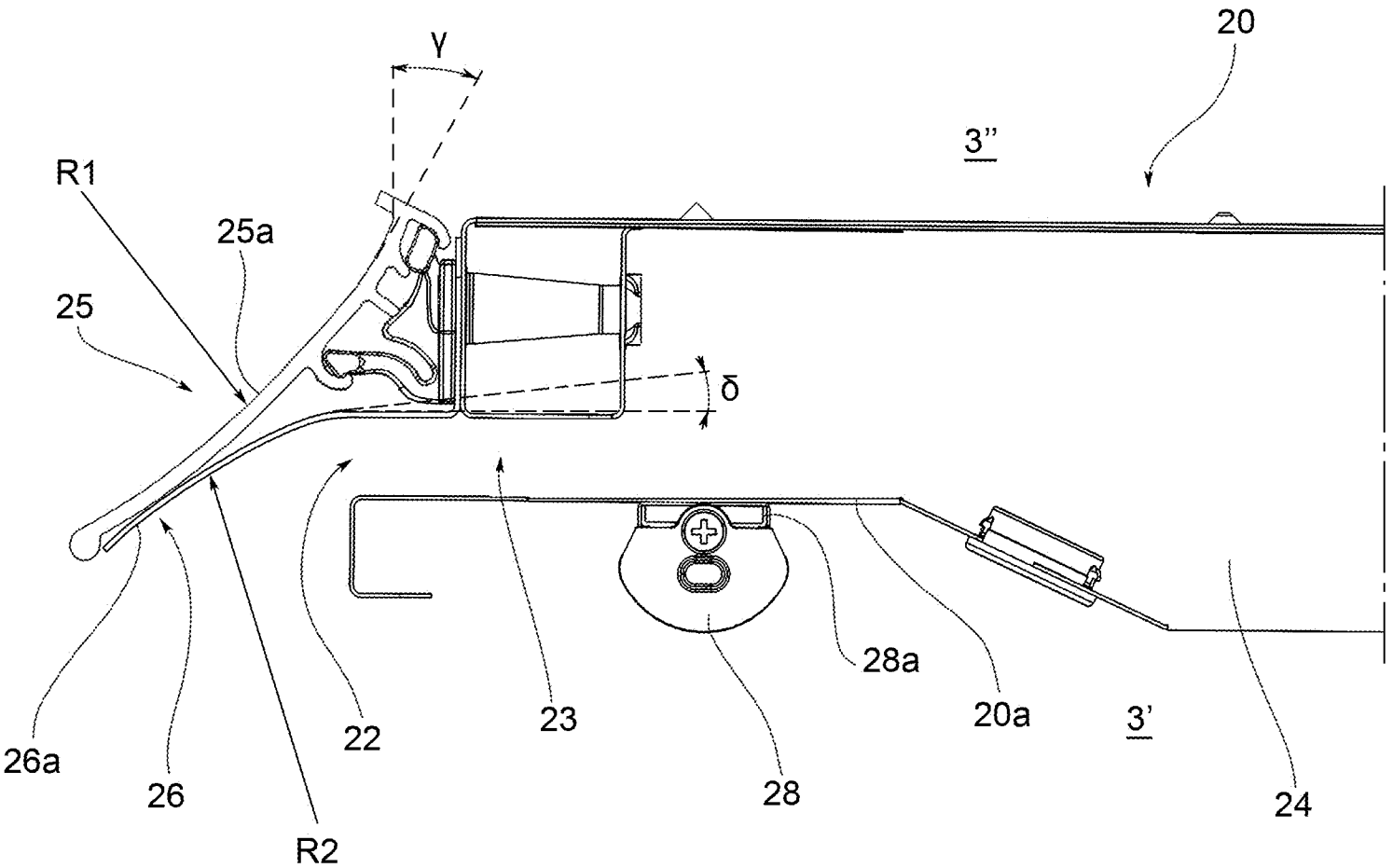
FIG. 11 shows an enlarged view of a blowing shelf according to an alternative embodiment of the present invention.

In accordance with a second embodiment, shown in FIG. 11, the deviation surface 25*a* of the first deflector 25 is defined by a curved surface, which directs its concavity towards the outside of the display compartment 3 and has a predetermined inlet angle $\gamma$ with respect to a vertical plane and a predetermined radius of curvature R1.

Advantageously, the inlet angle $\gamma$ is between 20° and 40°, and preferably between 25° and 35°; the radius of curvature R1 is between 130 and 90 mm, and preferably between 120 and 100 mm. In the case of a curved deflector, such an inlet angle and radius of curvature values allow obtaining the best compromise between the need to reduce the turbulence induced by the impact of the air flow on the first deflector 25 and the need to impose the higher horizontal component to the flow.

Preferably, the first deflector 25 extends longitudinally substantially throughout the frontal extension in length L of the blowing shelf 20 parallel to the main axis X so as to cover the entire longitudinal extension of the main air outlet mouth 6.

Advantageously, the deviation surface 25*a* of the refrigerated air flow of the first deflector 25 has a predefined width W1 transverse to the frontal extension in length L of the blowing shelf 20.

Preferably, the deviation surface 25*a* of the refrigerated air flow of the first deflector 25 is dimensioned in width W1 so as to intercept the refrigerated air flow which forms the air curtain so as to substantially influence the field of motion thereof.

Advantageously, the deviation surface 25*a* of the refrigerated air flow of the first deflector 25 can be dimensioned in width W1 so as to directly intercept only a part of the refrigerated air flow which forms the air curtain. In this case, the fact that the part of the flow deviated directly by the first deflector 25 exerts a dragging effect on the part of the flow not directly intercepted by the first deflector 25 is exploited, thus directly and indirectly influencing the motion field of the refrigerated air flow which forms the air curtain.

In particular, the predefined width W1 of the deviation surface 25*a* of the refrigerated air flow of the first deflector 25 can be between 50 mm and 75 mm, preferably between 55 mm and 70 mm, and even more preferably equal to 63 mm.

In accordance with the embodiment shown in the attached Figures, the second deflector 26 defines a deviation surface 26*a* of the refrigerated air flow, which is oriented towards the outside of the display compartment 3 and is facing downwards.

In accordance with a preferred embodiment, shown in FIGS. 9, 10 and 11, the deviation surface 26*a* of the second deflector 26 is defined by a flat surface, inclined towards the outside of the display compartment 3 by a first predefined angle β with respect to a horizontal plane.

Advantageously, the second predefined angle β is between 20 and 30°, preferably between 22° and 27°, and even more preferably equal to 25°. It has been experimentally verified that such angular values allow obtaining the best compromise between the need to reduce the turbulence induced by the impact of the air flow emitted by the blowing shelf 20 on the second deflector 26 and the need to impose on such a flow a direction as close as possible to the direction taken by the flow deviated by the first deflector 25.

In accordance with a second embodiment, shown in FIG. 11, the deviation surface 26*a* of the second deflector 26 is defined by a curved surface, which directs its concavity towards the inside of the display compartment 3. Such a curved surface has a predetermined inlet angle δ with respect to a horizontal plane and a predetermined radius of curvature R2.

Advantageously, the inlet angle δ is between 2° and 12°, and preferably between 4° and 8°; the radius of curvature R2 is between 150 and 110 mm, and preferably between 135 and 125 mm. In the case of a curved deflector, such an inlet angle and radius of curvature values allow obtaining the best compromise between the need to reduce the turbulence induced by the impact of the air flow on the second deflector 26 and the need to deviate the flow.

Preferably, the second deflector 26 extends longitudinally substantially throughout the frontal extension in length L of the blowing shelf 20 parallel to the main axis X so as to cover the entire longitudinal extension of the air-emitting secondary mouth 22.

Advantageously, the deviation surface 26*a* of the refrigerated air flow of the second deflector 26 has a predefined width W2 transversely to the frontal extension in length L of the blowing shelf 20.

Preferably, the deviation surface 26*a* of the refrigerated air flow of the second deflector 26 is dimensioned in width W2 so as to intercept the refrigerated air flow emitted by the blowing shelf 20 so as to substantially influence the field of motion thereof.

Advantageously, the deviation surface 26*a* of the refrigerated air flow of the second deflector 26 can be dimensioned in width W2 so as to directly intercept only a part of the refrigerated air flow emitted by the blowing shelf 20. In this case, the fact that the part of the flow deviated directly by the second deflector 26 exerts a dragging effect on the part of the flow not directly intercepted by the second deflector 26 is exploited, thus directly and indirectly influencing the motion field of the refrigerated air flow which forms the air curtain.

In particular, the predefined width W2 of the deviation surface 26*a* of the refrigerated air flow of the second deflector 26 can be between 25 mm and 40 mm, preferably between 30 mm and 38 mm, and even more preferably equal to 34 mm.

Advantageously, as shown in FIG. 12, the blowing shelf 20 can comprise channelling means 29', 29" to channel the air flow emitted by the blowing shelf 20.

More in detail, such channelling means 29', 29":

- are arranged between the second deflector 26 and the secondary air-emitting mouth 22; and
- are configured to make the refrigerated air flow exiting the secondary air-emitting mouth 22 more laminar.

Preferably, the air flow channelling means consist of one or more guide fins 29', 29" (as shown in FIG. 12) or of a honeycomb structure. In particular, the guide fins 29', 29" create channels which are parallel to each other.

Preferably, the channelling means 29', 29" of the air flow and the second deflector 26 are configured to reduce, in combination with each other, the free flow section for the refrigerated air flow emitted by the blowing shelf 20, so as to bring the air flow emitted by the blowing shelf 20 to have a speed substantially equivalent to the speed of the refrigerated air flow forming the air curtain downstream of the first deflector 25.

Operatively, the channelling means 29', 29", in cooperation with the second deflector 26, therefore make the flow of refrigerated air emitted by the blowing shelf 20 join, in the same direction and with the same speed, the flow of refrigerated air deviated by the first deflector 25.

In particular, the channelling means 29', 29" are dimensioned so as to obtain a reduction of the free passage section of the air near the outlet section of the second deflector 26 thus causing a local increase in speed but with a flow as laminar as possible.

The overall result is:

- a higher speed of the combined air flow (flow of the air curtain and flow from the blowing shelf) at the surface of the products arranged in the stepped loading portion and protruding with respect to the blowing shelf 20; and
- a reduced turbulence and air recirculation at and near the surface of the products arranged in the stepped loading portion and protruding with respect to the blowing shelf 20, with a consequent reduction in the infiltration of hot air outside the refrigerated compartment.

Therefore, on the surface of the products/foodstuffs arranged in the stepped loading portion and protruding with respect to the blowing shelf 20, a greater speed gradient and a greater density gradient is vertically generated (colder, and therefore denser, air adhering to the products).

The air flow then proceeds horizontally to pass the edge of the stepped loaded products to fall back, by virtue of the greater density, in the lower part, in the direction of the main air inlet mouth 5.

Advantageously, as shown in particular in FIGS. 10 and 11, the blowing shelf 20 can comprise a lighting device 28 which is placed in contact with the free end 23 of the blowing shelf 20. The lighting device 28 is provided with a support plate 28*a*. The support plate 28*a* of the lighting device 28 (where the maximum heat loss of the lighting device 28 is concentrated) is placed near a lower surface 20*a* of the blower shelf, which in use is in turn struck by the refrigerated air flow upstream of the second deflector 26 and of the channelling means 29', 29", if provided.

Thereby, it is possible to cool down the lighting device 28 associated with the blowing shelf 20 without causing turbulence in the flow of air emitted by the blowing shelf 20. In fact, the lighting device is arranged outside the internal channel of the blowing shelf.

The invention allows achieving several advantages which have been explained in the description.

The refrigerated display cabinet 1 of a vertical or semi-vertical type with a blowing shelf in accordance with the present invention allows reducing the turbulence deriving from the joining of the refrigerated air flows of the air curtain and the blowing shelf, respectively, at the portion for the stepped loading of the products inside the display area.

The refrigerated display cabinet 1 of a vertical or semi-vertical type with a blowing shelf in accordance with the present invention allows increasing the cooling efficiency at the portion for the stepped loading of the products inside the display compartment.

The refrigerated display cabinet 1 of a vertical or semi-vertical type with a blowing shelf in accordance with the present invention is constructionally simple to manufacture, with plant costs comparable to similar conventional refrigerated cabinets.

The refrigerated display cabinet 1 of a vertical or semi-vertical type with a blowing shelf according to the present invention is reliable and operatively simple to manage.

Therefore, the invention thus conceived achieves the intended purposes.

Obviously, in the practical embodiment thereof, it may also take other shapes and configurations from that shown above, without departing from the present scope of protection.

Moreover, all details may be replaced by technically equivalent elements, and any size, shape, and material may be used according to the needs.

What is claimed is:

1. A refrigerated display cabinet of a vertical or semi-vertical type with a blowing shelf, wherein said refrigerated display cabinet extends in length along a main axis and in depth along a secondary axis horizontally and transversely to the main axis, and comprises:

a containment structure that defines a product display compartment and an access opening to the product display compartment and comprises a main air inlet mouth and a main air outlet mouth both in communication with the main display compartment;

a channel that fluidically connects the main air inlet mouth with the main air outlet mouth so as to direct refrigerated air flow through the main air outlet mouth towards the main air inlet mouth along at least one portion of the access opening in the form of an air curtain, wherein said channel contains at least one evaporator connected to a refrigeration circuit and a plurality of fans, wherein said product display compartment is divided into an upper area comprising one or more shelves vertically overlapping each other and into a lower area that has a greater extension in depth than said upper area and is intended to be loaded with products with a step arrangement protruding frontally with respect to said one or more shelves, and wherein at least one of said shelves which separates said lower area from said upper area consists of the blowing shelf which:

comprises an internal conduit fluidically connected to said channel at a fixing end of the blowing shelf to the containment structure, and is suitable to direct the refrigerated air flow in the product display compartment through a secondary air-emitting mouth obtained near a free end of said blowing shelf opposite the fixing end, wherein said main air outlet mouth and the refrigerated display cabinet are overall configured so that the refrigerated air flow forming the air curtain laps the free end of said blowing shelf, and wherein said blowing shelf comprises:

a first deflector positioned at the free end so as to intercept the refrigerated air flow which forms the air curtain, the first deflector configured to deviate the intercepted refrigerated air flow from a vertical direction to a direction having a horizontal component, and to increase a local flow speed of the intercepted refrigerated air flow, to facilitate reducing turbulence and improving cooling efficiency in a stepped-loading area; and a second deflector positioned at an outlet of the secondary air-emitting mouth so as to intercept the refrigerated air flow emitted by said blowing shelf, the second deflector is being configured and oriented relative to said first deflector so that the refrigerated air flow emitted by the blowing shelf and deviated by the second deflector merges with the intercepted refrigerated air flow in has the same direction and with a matched flow speed, producing a combined laminar flow that travels in a horizontal direction extending towards the access opening of the display cabinet and past a front edge of the stepped-loaded area.

2. The refrigerated display cabinet of claim 1, wherein said first deflector connects with the free end of the blowing shelf so that there is no passing opening between the first deflector and the blowing shelf.

3. The refrigerated display cabinet of claim 1, wherein said first deflector is configured to also act as ticket holder.

4. The refrigerated display cabinet of claim 1, wherein said first deflector connects with said second deflector in an outlet area of air flows.

5. The refrigerated display cabinet of claim 1, wherein said first deflector and said second deflector are parts of a single profiled body.

6. The refrigerated display cabinet of claim 1, wherein said first deflector defines a deviation surface of the refrigerated air flow, which is oriented towards the access opening of the product display compartment and is facing upwards.

7. The refrigerated display cabinet of claim 6, wherein the deviation surface of said first deflector is defined by a flat surface, inclined towards the access opening of the product display compartment by a first predefined angle ($\alpha$) with respect to a vertical plane.

8. The refrigerated display cabinet of claim 7, wherein said first predefined angle ($\alpha$) is between 40° and 50°.

9. The refrigerated display cabinet of claim 6, wherein the deviation surface of said first deflector is defined by a curved surface, which directs its concavity towards the access opening of the product display compartment and has a predetermined inlet angle ($\gamma$) with respect to a vertical plane and a predetermined radius of curvature.

10. The refrigerated display cabinet of claim 9, wherein said predetermined inlet angle ($\gamma$) is between 20° and 40° and said radius of curvature is between 130 and 90 mm.

11. The refrigerated display cabinet of claim 6, wherein the deviation surface of the refrigerated air flow of said first deflector has a predefined width transverse to a front extension in length of said blowing shelf.

12. The refrigerated display cabinet of claim 11, wherein the predefined width of the deviation surface of the refrigerated air flow of said first deflector is between 50 mm and 75 mm.

13. The refrigerated display cabinet of claim 11, wherein the deviation surface of the refrigerated air flow of said first deflector is dimensioned in with to intercept the refrigerated air flow which forms the air curtain so as to influence a field of motion thereof.

14. The refrigerated display cabinet of claim 1, wherein said first deflector extends longitudinally throughout a frontal extension in length of said blowing shelf parallel to said main axis.

15. The refrigerated display cabinet of claim 1, wherein said second deflector defines a deviation surface of the refrigerated air flow, which is oriented towards the access opening of the product display compartment and is facing downwards.

16. The refrigerated display cabinet of claim 15, wherein the deviation surface of said second deflector is defined by a flat surface, inclined towards the access opening of the product display compartment by a second predefined angle (β) with respect to a horizontal plane.

17. The refrigerated display cabinet of claim 16, wherein said second predefined angle (β) is between 20° and 30°.

18. The refrigerated display cabinet of claim 15, wherein the deviation surface of said second deflector is defined by a curved surface, which directs its concavity towards inside of the product display compartment and has a predetermined inlet angle (δ) with respect to a vertical plane and predetermined radius of curvature.

19. The refrigerated display cabinet of claim 18, wherein said predetermined inlet angle (δ) is between 2° and 12° and said radius of curvature is between 150 and 110 mm.

20. The refrigerated display cabinet claim 15, wherein the deviation surface of the refrigerated air flow of said second deflector has a predefined width transverse to a frontal extension in length of said blowing shelf.

21. The refrigerated display cabinet of claim 20, wherein the predefined width of the deviation surface of the refrigerated air flow of said second deflector is between 25 mm and 40 mm.

22. The refrigerated display cabinet of claim 20, wherein the deviation surface of the refrigerated air flow of said second deflector is dimensioned in width to intercept the refrigerated air flow emitted by the blowing shelf so as to influence a field of motion thereof.

23. The refrigerated display cabinet of claim 1, wherein said second deflector extends longitudinally throughout a frontal extension in length of said blowing shelf parallel to said main axis.

24. The refrigerated display cabinet of claim 1, wherein said blowing shelf comprises channeling means arranged between the second deflector and the secondary air-emitting mouth and configured to make the refrigerated air flow leaving said secondary air-emitting mouth more laminar.

25. The refrigerated display cabinet of claim 24 wherein the channeling means consists of one or more guided fins or of a honeycomb structure.

26. The refrigerated display cabinet of claim 24, wherein the channeling means are configured to reduce a free flow section in a predefined manner so as to increase speed of the refrigerated air flow with respect to speed of the air in the internal conduit.

27. The refrigerated display cabinet of claim 24, wherein the channeling means and the second deflector are configured to reduce in combination with each other the free flow section for the refrigerated air flow emitted by the blowing shelf so as to bring the refrigerated air flow emitted by the blowing shelf to have a speed equivalent to the speed of the refrigerated air flow forming the air curtain downstream of the first deflector.

28. The refrigerated display cabinet of claim 1, wherein said blowing shelf comprises a lighting device placed near the free end of said blowing shelf and provided with a support plate, and wherein said support plate is placed in contact with a lower surface of the blowing shelf, which in use is struck by the refrigerated air flow upstream of the second deflector.

* * * * *